US005308662A

United States Patent [19]

Woodard et al.

[11] Patent Number: 5,308,662

[45] Date of Patent: May 3, 1994

[54] WINDOW CONSTRUCTION WITH UV PROTECTING TREATMENT

[75] Inventors: F. Eugene Woodard, Los Altos; Thomas G. Hood, San Francisco, both of Calif.

[73] Assignee: Southwall Technologies Inc., Palo Alto, Calif.

[21] Appl. No.: 731,044

[22] Filed: Jul. 16, 1991

[51] Int. Cl.[5] ..... E06B 3/24; E04C 2/54

[52] U.S. Cl. ..... 428/34; 428/192; 428/213; 52/789; 52/790

[58] Field of Search ..... 428/34, 192, 213, 68, 428/81, 206, 207, 458, 469, 702, 913; 156/107, 109; 52/171, 172, 788, 789, 790

[56] References Cited

U.S. PATENT DOCUMENTS 4,109,431 8/1978 Mazzoni et al. ..... 428/34

4,368,226 1/1983 Musaria ..... 428/34

FOREIGN PATENT DOCUMENTS 0307280 3/1989 European Pat. Off. .
0432872 6/1991 European Pat. Off. .
2711888 9/1978 Fed. Rep. of Germany .
3240639 5/1984 Fed. Rep. of Germany .
3500185 7/1986 Fed. Rep. of Germany .
3503851 8/1986 Fed. Rep. of Germany .

*Primary Examiner*—Donald J. Loney
*Attorney, Agent, or Firm*—Morrison & Foerster

[57] ABSTRACT

Seal failures on organically sealed multipane insulating window units are decreased if an opaque light barrier is applied directly to the outside surface of the outer glazing sheet. This barrier should be wide enough to prevent impingement on the seal of direct light and internally reflected light.

22 Claims, 3 Drawing Sheets

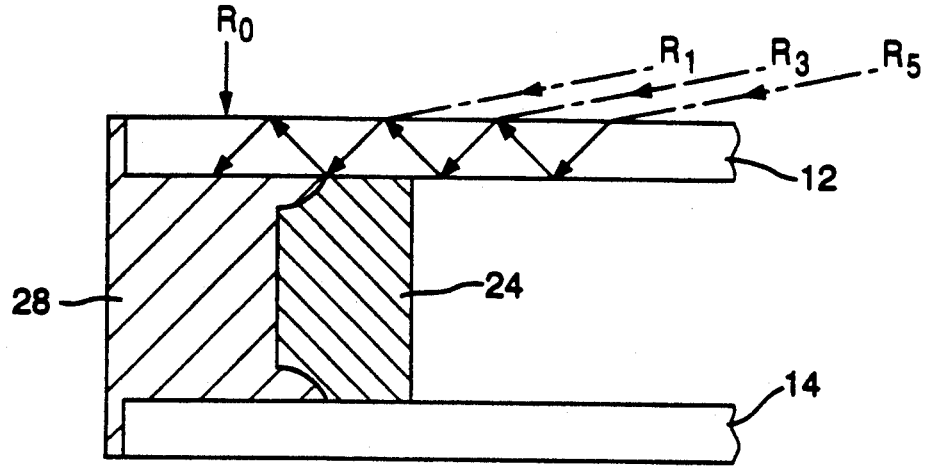
PRIOR ART FIG. 5
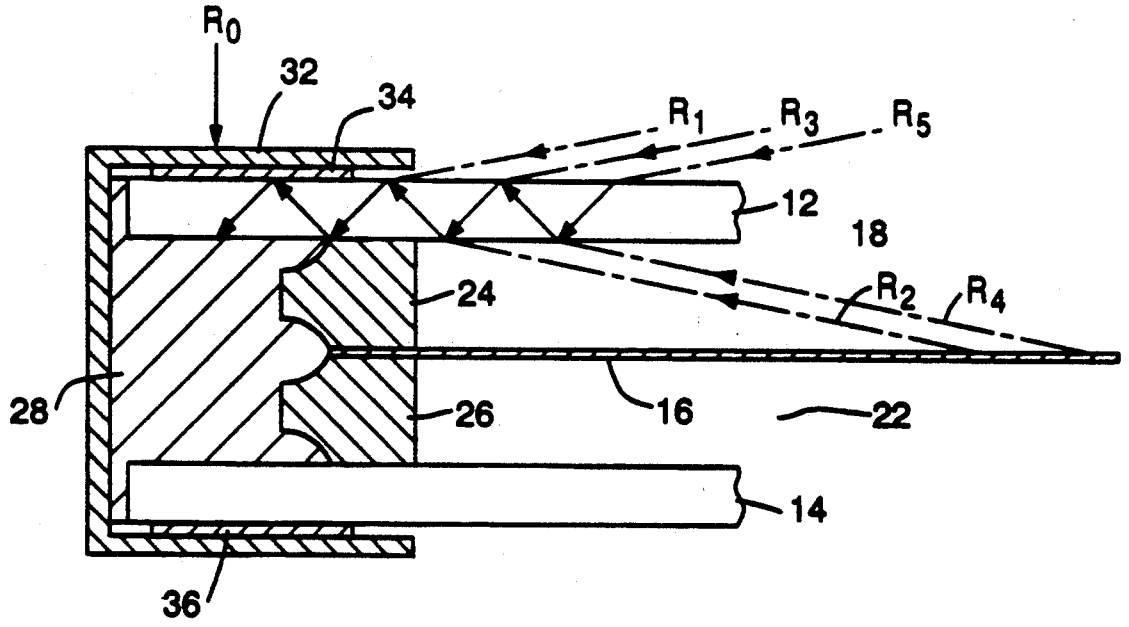
PRIOR ART FIG. 6

WINDOW CONSTRUCTION WITH UV PROTECTING TREATMENT

FIELD OF THE INVENTION

This invention relates to an improvement in multipane insulating windows. More particularly, it relates to an improvement in such windows which extends the life of their perimeter sealing system.

BACKGROUND OF THE INVENTION

In recent years, there has been increasing demand for high performance insulating windows. These windows typically include two or more sheets of rigid, transparent glazing material and may also include one or more sheets of nonrigid transparent material all held in parallel alignment to one another by an edge-seal system. This edge-seal may include spacer frame elements to position the glazing sheets relative to one another and a sealant to prevent moisture from entering and condensing in the voids between the glazing sheets.

A basic double glazing unit of the art is shown in FIG. 5 to include glazing sheets 12 and 14 (typically glass), and spacer 24 with a layer of adhesive 28 sealing the perimeter of the unit to keep out moisture which otherwise would condense on the internal surfaces of the glazing sheets.

A more advanced multipane glazing unit of the art is shown in FIG. 6. In this unit, glass sheets 12 and 14 and plastic film 16 make up three parallel glazing surfaces and define air or gas spaces 18 and 22. Sheets 12 and 14 and film 16 are spaced from one another by spacers 24 and 26 and the edge of the unit is sealed with adhesive 28. Typically, in both cases this sealant 28 is an elastomeric adhesive material which adheres to the sheets of glazing and helps to join then to the spacers. As the performance of these windows has improved, they have been employed in applications of ever-increasing harshness.

In these harsher environments, these windows often fail prematurely. Impact of sunlight on the sealant-/adhesive (such as the impact of Rays $R_o$ and/or $R_1$ 28 in the prior art drawings) can have the effect of cross-linking and hardening the sealant. This can lead to embrittlement and a breakdown in the bond of the sealant to the glass panes and other components. One approach to solving this problem has been to use silicone materials as adhesive sealants. Silicones are quite resistant to light-induced cross-linking and hardening but have the serious failing that they are very readily permeated by water vapor. This leads to moisture condensing and collecting within the window structure. The solution to this moisture problem is to employ a two layer-two material seal system. The application of the seal systems is time consuming, labor intensive, and high priced.

Alternatively, especially when using organic sealants such as polyurethanes and polysulfides, this problem has been avoided here-to-fore at least in part by encasing the edge of the units in a mullion cap. Such a cap 32 is held in place by foam adhesives 34 and 36 in the prior art FIG. 6. These caps have been used for their architectural and fabrication properties but have also shielded the sealant/adhesive from the direct rays of the sun such as ray $R_o$ shown in the two prior art figures which is seen entering the sealant in FIG. 5.

The use of mullion caps does to some extent protect the adhesive/sealant, but certain practical problems prevent these from being completely effective in many applications. The caps are easily dislodged and forced out of alignment, they often do not fit flush to the outside of the glass and they can lend themselves to poor alignment due to installation error or poor engineering design. See, for example, the gap shown in the prior art figure.

The use of mullion caps has helped but has had problems. The caps are expensive, they are easily dislodged and forced out of alignment and also, they often do not fit flush to the outside of the glass. See, for example, the gap shown in the prior art figure. Typically, this gap was not considered to be a problem. Recently, however, increasing failure rates have been noted for seals in windows as shown in this figure. In addition, these mullion caps primarily serve to block direct incident exposure (rays $R_o$ and $R_1$) and do not take into account that there is substantial amounts of light reaching the sealant through internal reflection within the outer glazing sheet itself. Such light as shown as rays $R_3$ and $R_5$ in FIG. B.

STATEMENT OF THE INVENTION

It has now been found that the problem of seal failure in multipane windows is caused in major part by light, especially ultraviolet light, entering the seal material via the glazing sheet to-mullion gap or some other mechanical deficiency present in conventional window designs and via internal reflection within the outer glazing pane.

It has been found that this problem can be solved to a substantial degree by applying particular configurations of an opaque nonreflective light barrier directly to the exterior surface of the outer pane of glazing in the multipane window.

This light barrier typically is a nonreflective dark tape. In one embodiment it is applied so as to cover the sealant to be protected and to extend beyond the sealant by at least 0.89 times the thickness of the outer glazing pane.

In another embodiment the tape is applied as a strip on the glazing positioned to be straddling the inner edge of the spacer by a distance in each direction of at least 0.89 times the thickness of the outer glazing pane.

In both configurations these distances are sufficient to prevent any direct UV energy from impacting the sealant/adhesive. These configurations also minimize indirect (internally reflected) UV energy impact on the sealant/adhesive.

In preferred embodiments, the barrier is a dark colored-adhesive tape or opaque coating.

In additionally preferred embodiments, the inner and outer glazing sheets are glass sheets; the window unit additionally includes a plastic film parallel to and intermediate the two glazing sheets; and this plastic film carries a heat-reflective metal coating with or without accompanying dielectric layers.

BRIEF DESCRIPTION OF THE DRAWINGS

This invention will be further described with reference being made to the accompanying drawings in which the figures marked Prior Art A and B are depictions of multipane windows of the art showing the problem addressed by the present invention.

FIG. 5 is a cross-sectional view of one embodiment of a multipane window of the prior art.

FIG. 6 is a cross-sectional view of a second embodiment of a multipane window of the prior art.

In all these figures like numbers will be used to identify like elements.

DETAILED DESCRIPTION OF THE INVENTION

Figure 1:
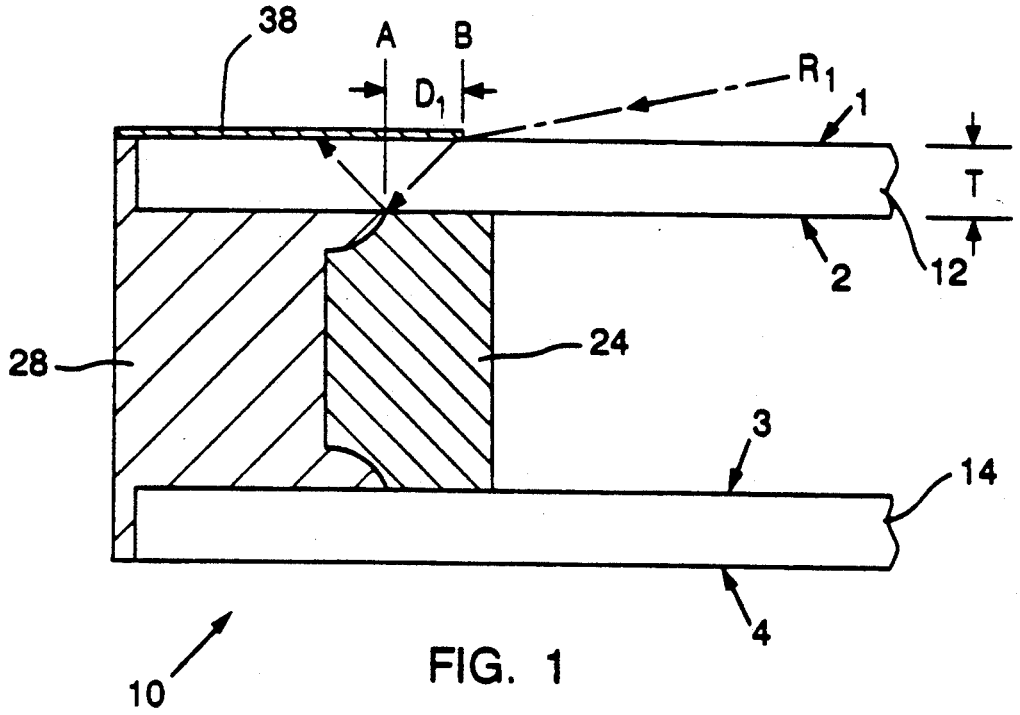
FIG. 1 is a cross-sectional view of a multipane window employing one embodiment of the present invention (window 10).

Turning to FIG. 1, a window 10 in accord with the present invention is shown. It, like the prior art, includes glazing panes 12 (outside) and 14 (inside), typically made of glass but possibly of carbonate, acrylate or a like plastic material. The terms "outer" and "inner" when used herein to differentiate between glazing sheets refers to their position in a typical architectural setting—"outer" being on the exterior of the building and "inner" being on the interior. These surfaces are shown as 1 and 4 respectively in FIG. 1. The term "inner" and "outer" when used to differentiate between surfaces present in a multipane window are used on a somewhat different sense. The two surfaces, 2 and 3 in FIG. 1, bounding the void volume being "inner" surfaces and the two surfaces, 1 and 4, being "outer" surfaces. These panes are spaced from one another by spacer 24 which is located substantially at their periphery. Spacer can be diffuse (brushed finish) or specular. Sealant 28 fixes these pieces together as do adhesive layers (not shown) between the panes and the spacer.

Glazing pane 12 had a thickness, T, typically ⅛" or ¼" or the like. Sealant 28 extends from the periphery of the window unit in to a point A where it meets the spacer 24. In this embodiment, a strip of opaque UV-absorbing light barrier 38 is applied directly to the outside surface of outside glazing pane 12. This strip extends from the periphery to a point B. B is selected to be a distance beyond A which is at least 0.89 times T. This distance is shown as $D_1$. Thus the opaque UV absorber "overhangs" the sealant by $D_1$ which equals at least 0.89 T. In this configuration, ray $R_1$ is the last possible ray not directly blocked by layer 38. It can be seen that it is unable to reach the adhesive 28 directly and instead bounces off the spacer 24 (either specularly as shown or diffusely, if the spacer has a diffuse surface) into the UV absorbing layer 38.

The value of 0.89 T was determined based on the tangent of the maximum angle for light to pass through a typical glass glazing. If another glazing material having a different index of refraction was employed, this angle and hence tangent value would change.

Figure 2:
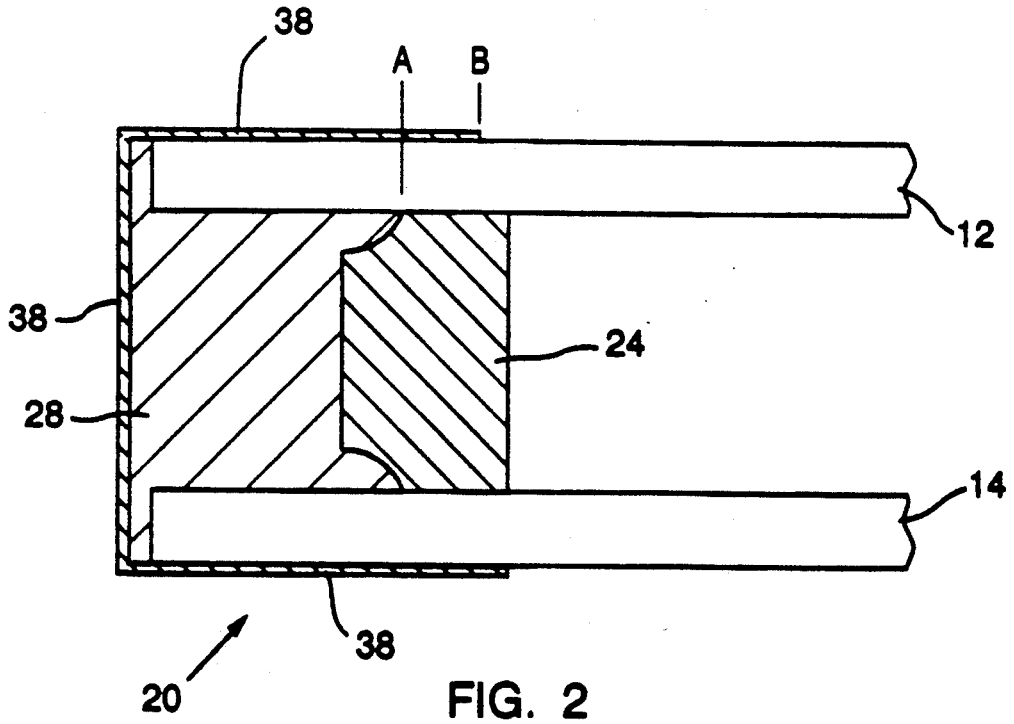
FIG. 2 is a cross-sectional view of a multipane window employing the present invention (window 20).

In this embodiment, layer 38 can extend further out beyond point B such as to 1 T or 2 T or greater, if desired, but should not cover less than the full distance between points A and B. As shown in FIG. 2, this layer 38 can be applied not only to the top (outer) surface of pane 12 but also can be extended so as to cover and surround the entire outside edge of the window unit. This can be done to enhance the seal around the window or for esthetics.

Figure 3:
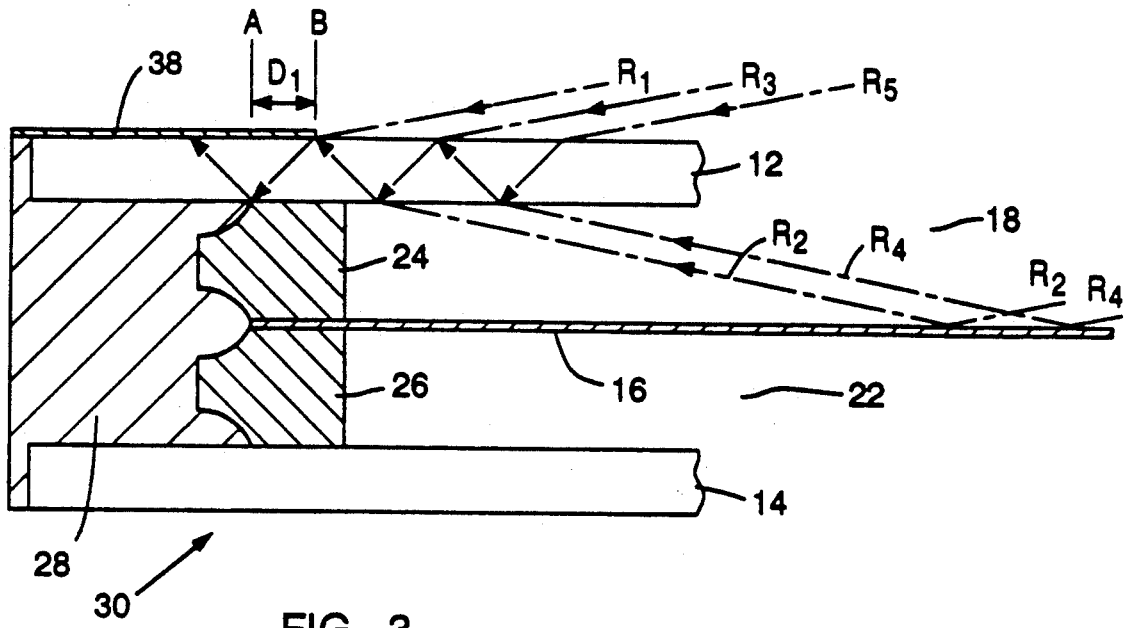
FIG. 3 is a cross-sectional view of a multipane window employing the present invention (window 30). This embodiment has an internal plastic film carrying a heat-reflective coating in its structure.

As shown in FIG. 3, this invention also finds application on window units containing a more complex structure such as including a plastic film suspended by spacers 24 and 26. Film 16 can carry a metallized film on its surface which will have the effect of reflecting light and UV to at least a certain extent. Such reflected energy is shown as rays $R_2$ and $R_4$ which can be seen to be dealt with as effectively as were rays $R_1$, $R_3$ and $R_5$ which were internally reflected in glazing layer 12.

Figure 4:
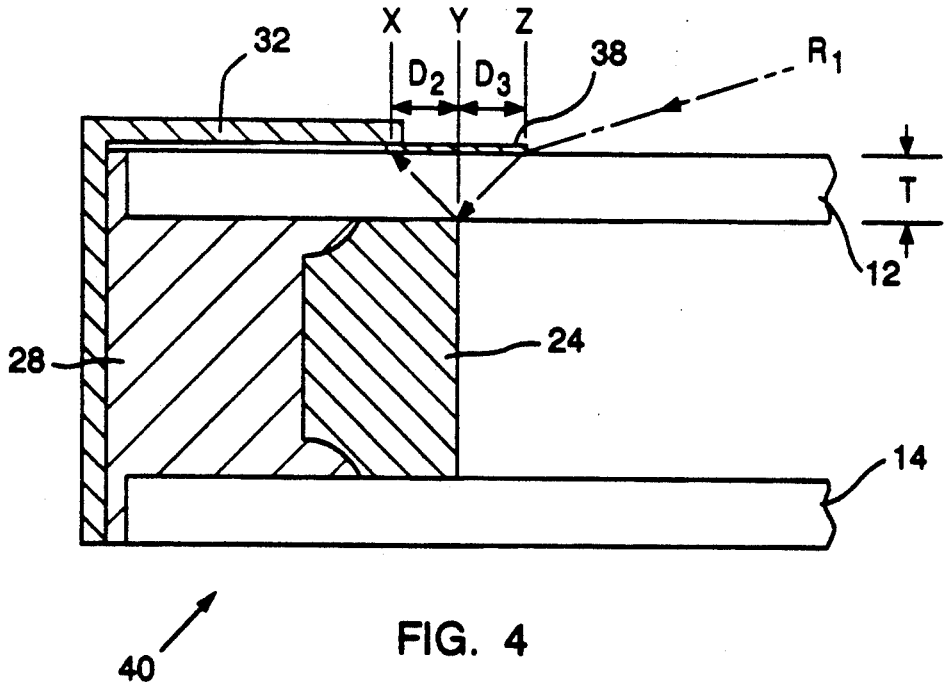
FIG. 4 is a cross-sectional view of a multipane window employing a second embodiment of this invention (window 40).

In an alternative embodiment, the opaque UV-absorbing layer can be positioned as shown in FIG. 4. In this embodiment panes 12 and 14, spacer 24 and sealant 28 are as previously described. The dark UV-absorbing opaque surface is applied to the outside surface of pane 12 straddling the inside edge ("4") of the spacer 24. In this embodiment, the UV-absorbing layer extends a distance $D_2$ and a distance $D_3$ from the "Y" position. $D_2$ and $D_3$ are each equal to at least 0.89 T, where T is the thickness of glazing sheet 12. As can be seen, ray $R_1$ is the last possible unblocked ray reflecting off of the inside surface of sheet 12. It reflects off of the sheet surface, not off of spacer 24 which can be specular or diffuse. Ray $R_1$ is reflected so as to be absorbed by layer 38 and not reach sealant 28. In this embodiment, the dark surface of layer 38 could extend beyond distance $D_2$ and cover the outer surface out to the periphery or, as shown, could be stopped after covering $D_2$ and $D_3$ with a mullion cap such as 32 or the like covering the remainder of the distance to the edge of the glazing. The embodiment of FIGS. 1, 2 and 3 may be preferred as this does not decrease the transparent area ("viewing area") of window unit 10 since the dark surface area has already been "blocked out" by the spacer and sealant.

The material used for light barrier 38 can be a paint or an ink applied directly to the surface of pane 12 or it can be an adhesive tape material also applied directly to pane 12. Layer 38 must be substantially nonreflective on the side facing pane 12 (the "underside"). It should be opaque, preferably dark colored and matte. As will be seen with reference to FIG. 1 and the prior art figures, light can enter the sealant via internal reflection in the glazing pane 12. If layer 38 is light or UV reflective on its underside, it will promote the undesired internal reflection effect.

Presently most preferred materials for layer 38 are dark (black or brown) matte adhesive tapes. The best mode presently known is a black-coated product marketed by 3 M Company and made up of three layers: a 1-mil thick cast black polyurethane, a 5-mil thick thermoplastic rubber carrier layer and 1-mil thick pigmented acrylic pressure-sensitive adhesive layer. It is believed that this product absorbs 99.5% of the internally reflected rays which impinge upon it and stops virtually 100% of the direct rays which strike it.

In the best modes presently contemplated for providing this invention, layer 38 is used around the entire edge of the window unit and the window unit itself has a center-film-triple-glazed structure as shown in FIG. 3. Also, the film 16 contains a heat-reflective coating. This type of film is sold by Southwall Technologies Inc. under its trademark, Heatmirror. This type of film selectively transmits light and selectively reflects heat (I.R.). The film per se is not the present invention but its use in combination with the elements of this invention is preferred.

What is claimed is:

1. In a multiple-pane insulating window assembly having an exterior wall surface and an interior wall surface, said assembly comprising an outer first and an inner second sheet of transparent glazing, each having a perimeter edge surface and an inner surface and an outside surface, the outer first sheet having a sheet thickness with the sheets being held substantially parallel to one another and spaced from one another by an elongated spacer which abuts the inner surfaces of the two sheets at, but inset by a first set distance from, the periphery of the two sheets and extends inward to a second set distance from the periphery, such that the outer surface of the first sheet is the exterior wall surface and the outer surface of the second sheet is the interior wall surface, and a layer of an adherent conforming flexible sealant which sealably surrounds the outside of the spacer and the perimeter edge of the sheets and fills the first distance inset, the improvement comprising an opaque nonreflective light barrier applied directly onto the exterior wall surface and extending inward from the periphery of the first sheet to a position that is at least 0.89 times the sheet thickness past the first set distance.

2. The improved multiple-pane insulating window assembly of claim 1 wherein the opaque nonreflective light barrier is additionally extends from the periphery of the second sheet over the sealant layer.

3. The improved multiple-pane insulating window assembly of claim 2 wherein the opaque nonreflective light barrier is additionally applied onto the interior wall surface.

4. The improved multiple-pane insulating window assembly of claim 1 wherein the opaque nonreflective light barrier is dark-colored nonreflective adhesive tape.

5. The improved multiple-pane insulating window assembly of claim 2 wherein the opaque nonreflective light barrier is dark-colored adhesive tape.

6. The improved multiple-pane insulating window assembly of claim 3 wherein the opaque nonreflective light barrier is dark-colored adhesive tape.

7. The improved multiple-pane insulating window assembly of claim 6 wherein the dark-colored adhesive tape is black adhesive tape.

8. The improved multiple-pane insulating window assembly of claim 1 wherein the opaque nonreflective light barrier is a flat dark-colored coating.

9. The improved multiple-pane insulating window assembly of claim 1 wherein the first and second sheets of transparent glazing are each sheets of glass.

10. The improved multiple-pane insulating window of claim 1 wherein the window additionally comprises a transparent plastic film parallel to and intermediate the first and second sheets of transparent glazing and held in position by the elongated spacer.

11. The improved multiple-pane insulating window of claim 10 wherein the transparent plastic film has a flat surface parallel to the sheet of glazing which carries a heat-reflective visible light transmissive metal-containing coating.

12. The improved multiple-pane insulating window of claim 11 wherein the metal-containing coating comprises a layer of silver disposed between two layers of metal oxide.

13. In a multiple-pane insulating window assembly having an exterior wall surface and an interior wall surface, said assembly comprising an outer first and an inner second sheet of transparent glazing, each having a perimeter edge surface and an inner surface and an outside surface, the outer first sheet having a sheet thickness with the sheets being held substantially parallel to one another and spaced from one another by an elongated spacer which abuts the inner surfaces of the two sheets at, but inset by a first set distance from, the periphery of the two sheets and extends inward to a second set distance from the periphery, such that the outer surface of the first sheet is the exterior wall surface and the outer surface of the second sheet is the interior wall surface, and a layer of an adherent conforming flexible sealant which sealably surrounds the outside of the spacer and the perimeter edge of the sheets and fills the first distance inset, the improvement comprising an opaque nonreflective light barrier applied directly onto the exterior wall surface and extending inward from the second set distance by a distance which is at least 0.89 times the sheet thickness and extending outward from the second set distance by a distance which is at least 0.89 times the sheet thickness.

14. The improved multiple-pane insulating window assembly of claim 13 additionally comprising a light impermeable surface extending from the periphery of the exterior wall surface to said opaque light barrier.

15. The improved multiple-pane insulating window assembly of claim 13 wherein the opaque nonreflective light barrier is dark-colored adhesive tape.

16. The improved multiple-pane insulating window assembly of claim 14 wherein the opaque nonreflective light barrier is dark-colored adhesive tape.

17. The improved multiple-pane insulating window assembly of claim 13 wherein the dark-colored adhesive tape is black adhesive tape.

18. The improved multiple-pane insulating window assembly of claim 13 wherein the opaque nonreflective light barrier is a flat dark-colored coating.

19. The improved multiple-pane insulating window assembly of claim 13 wherein the first and second sheets of transparent glazing are each sheets of glass.

20. The improved multiple-pane insulating window of claim 13 wherein the window additionally comprises a transparent plastic film parallel to and intermediate the first and second sheets of transparent glazing and held in position by the elongated spacer.

21. The improved multipane insulating window of claim 20 wherein the transparent plastic film has a flat surface parallel to the sheet of glazing which carries a heat-reflective visible light transmissive metal-containing coating.

22. The improved multiple-pane insulating window of claim 21 wherein the metal-containing coating comprises a layer-of silver disposed between two layers of metal oxide.

* * * * *